US011507008B2

(12) United States Patent
Izumi et al.

(10) Patent No.: US 11,507,008 B2
(45) Date of Patent: Nov. 22, 2022

(54) IMAGE FORMING APPARATUS

(71) Applicant: TOSHIBA TEC KABUSHIKI KAISHA, Tokyo (JP)

(72) Inventors: Takao Izumi, Yokohama Kanagawa (JP); Suguru Kurita, Shizuoka (JP); Hiromichi Mitamura, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/172,928

(22) Filed: Feb. 10, 2021

(65) Prior Publication Data

US 2022/0253011 A1 Aug. 11, 2022

(51) Int. Cl.
*G03G 15/00* (2006.01)

(52) U.S. Cl.
CPC ..... *G03G 15/5062* (2013.01); *G03G 15/5041* (2013.01); *G03G 15/5058* (2013.01); *G03G 15/55* (2013.01); *G03G 2215/00029* (2013.01); *G03G 2215/00033* (2013.01); *G03G 2215/00037* (2013.01); *G03G 2215/00059* (2013.01); *G03G 2215/00067* (2013.01)

(58) Field of Classification Search
CPC ..... G03G 15/5062; G03G 15/5041; G03G 15/55; G03G 2215/00029; G03G 2215/00033; G03G 2215/00037; G03G 2215/00059; G03G 2215/00067
See application file for complete search history.

(56) References Cited

U.S. PATENT DOCUMENTS

2003/0235418 A1* 12/2003 Furno ..... G03G 15/50 399/72
2005/0152706 A1* 7/2005 Koie ..... G03G 15/5062 399/15
2006/0165442 A1 7/2006 Kobayashi et al.
2010/0238465 A1* 9/2010 Kageyama ..... G03G 15/0194 358/1.9
2011/0188870 A1* 8/2011 Kobayashi ..... G03G 15/01 399/39

(Continued)

FOREIGN PATENT DOCUMENTS

JP 2000-132364 5/2000
JP 2004287403 A * 10/2004 ..... G03G 15/0194

(Continued)

*Primary Examiner* — Ryan D Walsh
(74) *Attorney, Agent, or Firm* — Foley & Lardner LLP

(57) ABSTRACT

An image forming apparatus includes an image carrier, an image forming unit, a transfer unit, a detector, a controller, an edge detector, and an abnormality detector. The detector detects developer attached to an image carrying surface at a position between a position where an image is formed and a position where the image is transferred. The controller controls the image forming unit such that a check image including an edge that extends in a direction intersecting the moving direction of the image carrying surface is formed in a region of the image carrying surface that passes through the detection position. The edge detector determines a position of the edge based on a detection status of the developer. The abnormality detector determines whether or not the image former is abnormal based on the position of the edge.

13 Claims, 6 Drawing Sheets

(56) References Cited

U.S. PATENT DOCUMENTS

| | | | | |
|---|---|---|---|---|
| 2015/0165785 | A1* | 6/2015 | Washington | G03G 15/5041 347/134 |
| 2015/0370196 | A1* | 12/2015 | Ozaki | G03G 15/0856 399/9 |
| 2019/0163108 | A1* | 5/2019 | Sakurada | G03G 15/043 |

FOREIGN PATENT DOCUMENTS

| | | |
|---|---|---|
| JP | 2010-039071 | 2/2010 |
| JP | 2017-053965 | 3/2017 |

* cited by examiner

IMAGE FORMING APPARATUS

FIELD

Embodiments described herein relate generally to an image forming apparatus.

BACKGROUND

An electrophotographic image forming apparatus includes a function for detecting an abnormality in an image forming operation based on an image formation status on an image carrier.

However, in this image forming apparatus, a complicated test pattern is formed to obtain a numerical value such as a density value representing the image formation status, and a required numerical value is needed for accurate measurement.

DETAILED DESCRIPTION

In general, according to at least one embodiment, an image forming apparatus is provided. The image forming apparatus includes an image carrier, an image forming unit, a transfer unit, a detection unit (e.g., a detector), a control unit (e.g., a controller), an edge determination unit (e.g., an edge detector), and an abnormality determination unit (e.g., an abnormality detector). The image carrier has an image carrying surface configured to move in a moving direction. The image forming unit is configured to form an image on the image carrying surface with a developer at a formation position. The transfer unit is configured to transfer the image formed on the image carrying surface to a medium at a transfer position. The detection unit is configured to detect the developer attached to the image carrying surface at a detection position determined between the formation position and the transfer position. The control unit is configured to control the image forming unit such that a check image is formed in a region of the image carrying surface that passes through the detection position, the check image including an edge that extends in a direction intersecting the moving direction. The edge determination unit is configured to determine a position of the edge based on a detection status of the developer by the detection unit. The abnormality determination unit is configured to determine whether or not the image forming unit is abnormal based on the position of the edge determined by the edge determination unit.

Hereinafter, at least one embodiment will be described using the drawings. In at least one embodiment, a multifunction peripheral (MFP) including an image forming apparatus as a printer will be described as an example. The content of various operations and processes described below is merely exemplary and, for example, change in the order of a part of the operations of the processes, omission of a part of the operations of the processes, or addition of another operation and another process can be appropriately made.

First, a configuration of the MFP according to at least one embodiment will be described.

Figure 1:
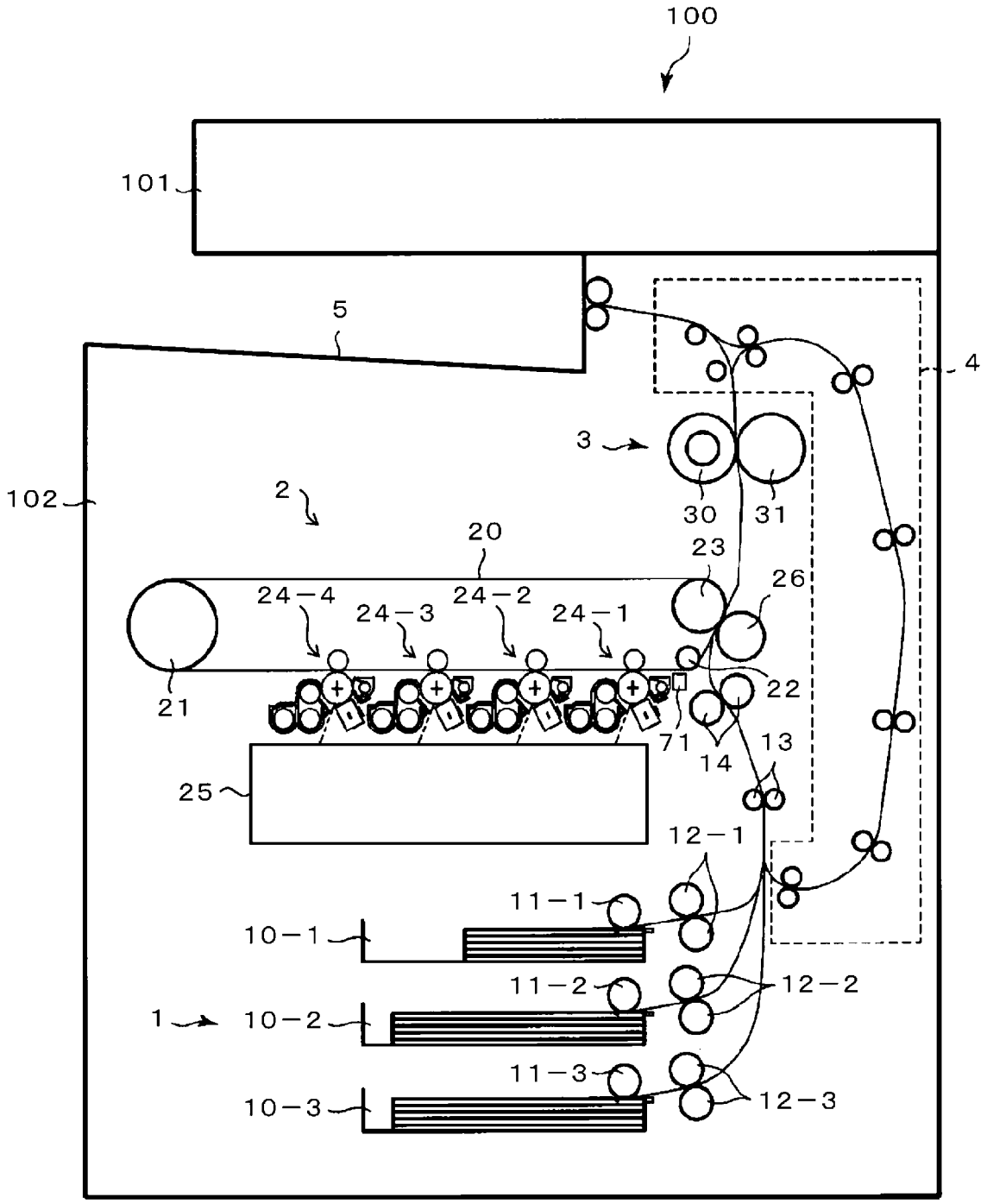
FIG. 1 is a diagram schematically illustrating a mechanical configuration of an MFP according to an example embodiment.

FIG. 1 is a diagram schematically illustrating a mechanical configuration of an MFP 100 according to at least one embodiment.

As illustrated in FIG. 1, the MFP 100 includes a scanner 101 and a printer 102.

The scanner 101 reads an image of a document and generates image data corresponding to the image. For example, the scanner 101 generates image data corresponding to a reflected light image from a surface of a document to be read using an image sensor such as a charge-coupled device (CCD) line sensor. The scanner 101 scans a document placed on a document tray using an image sensor that moves along the document. Alternatively, the scanner 101 scans a document that is conveyed by an auto document feeder (ADF) using a fixed image sensor.

The printer 102 forms an image using an electrophotographic method on a medium on which an image is to be formed. Typically, the medium is print paper such as cut paper. Therefore, in the following description, print paper is used as the medium. As the medium, a sheet of another paper different from cut paper may be used, or a sheet of a material such as a resin other than paper may be used. The printer 102 has a color printing function of printing a color image on print paper and a monochrome printing function of printing a monochrome image on print paper. The printer 102 forms a color image by forming element images to overlap each other with, for example, developers of three colors including yellow, magenta, and cyan or four colors black in addition to the three colors. In addition, the printer 102 forms a monochrome image, for example, with a black developer. The developer is, for example, toner. The developer may contain, for example, toner and a carrier. The printer 102 may include only either one of the color printing function or the monochrome printing function.

In the configuration example illustrated in FIG. 1, the printer 102 includes a paper feed unit 1 (e.g., a paper feeder), a print engine 2, a fixing unit 3, an automatic double-sided unit (ADU) 4, and a paper discharge tray 5.

The paper feed unit 1 includes paper feed cassettes 10-1, 10-2, and 10-3, pickup rollers 11-1, 11-2, and 11-3, conveying rollers 12-1, 12-2, and 12-3, a conveying roller 13, and a registration roller 14.

The paper feed cassettes 10-1, 10-2, and 10-3 accommodate sheets of print paper in a state where the sheets are stacked. The sheets of print paper accommodated in the paper feed cassettes 10-1, 10-2, and 10-3 may be different types of print paper having different sizes and materials or may be the same type of print paper. In addition, the paper feed unit 1 may include a manual feed tray.

The pickup rollers 11-1, 11-2, and 11-3 pick up the print paper from each of the paper feed cassettes 10-1, 10-2, and 10-3 one by one. The pickup rollers 11-1, 11-2, and 11-3 supply the picked print paper to the conveying rollers 12-1, 12-2, and 12-3.

The conveying rollers 12-1, 12-2, and 12-3 supply the print paper supplied from the pickup rollers 11-1, 11-2, and 11-3 to the conveying roller 13 through a conveyance path formed by a guide member (not illustrated), for example.

The conveying roller 13 further conveys and supplies the print paper supplied from any one of the conveying rollers 12-1, 12-2, and 12-3 to the registration roller 14.

The registration roller 14 corrects a tilt of the print paper. The registration roller 14 adjusts a timing at which the print paper is supplied to the print engine 2.

The paper feed cassettes, the pickup rollers, and the conveying rollers are not limited to three sets, and the number of sets may be freely set. In addition, when the manual feed tray is provided, it is not necessary to provide even one set including the paper feed cassette, the pickup roller, and the conveying roller, the paper feed cassette being paired with the pickup roller and the conveying roller.

The print engine 2 includes a belt 20, support rollers 21, 22, and 23, image forming units 24-1, 24-2, 24-3, and 24-4, an exposure unit 25 (e.g., an exposer), and a transfer roller 26.

The belt 20 has an endless shape and is supported by the support rollers 21, 22, and 23 to maintain the state illustrated in FIG. 1. The belt 20 rotates counterclockwise in FIG. 1 along with the rotation of the support roller 21. The belt 20 temporarily carries a developer image on a surface positioned on the outside (hereinafter, referred to as "image carrying surface"), the developer image being an image to be formed on the print paper. That is, the belt 20 is an example of the image carrier. From the viewpoints of heat resistance and wear resistance, for example, a semi-conductive polyimide is used as the belt 20. The image carrying surface moves along with the rotation of the belt 20 such that so-called sub-scanning is implemented, and a moving direction of the image carrying surface will also be referred to as "sub-scanning direction".

Each of the image forming units 24-1 to 24-4 includes a photoreceptor, a charging unit (e.g., a charger), a developing unit (e.g., a developer), a transfer roller, and a cleaner. Each of the image forming units 24-1 to 24-4 have a well-known structure for forming an image using an electrophotographic method in cooperation with the exposure unit 25. The image forming units 24-1 to 24-4 are arranged along the belt 20 in a state where axial directions of the photoreceptors thereof are parallel to each other. The image forming units 24-1 to 24-4 have the same structure and operation except that only the colors of the developers to be used are different from each other. The image forming unit 24-1 forms an element image, for example, with a black developer. The image forming unit 24-2 forms an element image, for example, with a cyan developer. The image forming unit 24-3 forms an element image, for example, with a magenta developer. The image forming unit 24-4 forms an element image, for example, with a yellow developer. The image forming units 24-1 to 24-4 form the respective color element images to overlap each other on the image carrying surface of the belt 20. As a result, the image forming units 24-1 to 24-4 form a color image in which the respective color element images overlap each other on the image carrying surface of the belt 20 when the image carrying surface passes through the image forming unit 24-1. Although not illustrated in the drawing, developer containers containing the respective color developers are arranged, for example, in spaces above the belt 20. Thus, each of the image forming units 24-1 to 24-4 is an example of the image forming unit.

The exposure unit 25 exposes the photoreceptor of each of the image forming units 24-1 to 24-4 in accordance with image data representing the respective color element images. As the exposure unit 25, for example, a laser scanner or a light emitting diode (LED) head is used. When the laser scanner is used, for example, the exposure unit 25 includes a semiconductor laser element, a polygon mirror, an imaging lens system, and a mirror. In this case, the exposure unit 25 selectively deflects, for example, a laser beam emitted from the semiconductor laser element in accordance with image data to the respective photoreceptors of the image forming units 24-1 to 24-4 by changing an emission direction from the mirror. In addition, the exposure unit 25 deflects the laser beam in the axial direction of the photoreceptor (a depth direction in FIG. 1) with the polygon mirror for scanning the photoreceptor. This scanning with the laser beam is a so-called main scanning, and the direction thereof will be referred to as "main scanning direction".

The transfer roller 26 is arranged parallel to the support roller 23, and the belt 20 is interposed between the transfer roller 26 and the support roller 23. The print paper supplied from the registration roller 14 is interposed between the transfer roller 26 and the image carrying surface of the belt 20. The transfer roller 26 transfers the developer image formed on the image carrying surface of the belt 20 to the print paper using an electrostatic force. That is, the support roller 23 and the transfer roller 26 configure the transfer unit. The developer may remain on the image carrying surface of the belt 20 without being completely transferred to the print paper. Therefore, the developer attached to the image carrying surface of the belt 20 after the image carrying surface passes through a gap between the support roller 23 and the transfer roller 26 is removed by the cleaner (not illustrated) before reaching the image forming unit 24-4.

Thus, the print engine 2 forms the image using an electrophotographic method on the print paper supplied by the registration roller 14.

The fixing unit 3 includes a fixing roller 30 and a pressurization roller 31.

In the fixing roller 30, a heater is configured in a hollow roller formed of, for example, a heat-resistant resin. The heater is, for example, an induction heater (IH), and any other type of heater can be appropriately used. The fixing roller 30 melts the developer that is attached to the print paper supplied from the print engine 2 such that the developer is fixed to the print paper.

The pressurization roller 31 is provided parallel to the fixing roller 30 and pressed against the fixing roller 30. The print paper supplied from the print engine 2 is interposed between the pressurization roller 31 and the fixing roller 30 and is pressed against the fixing roller 30 by the pressurization roller 31.

The ADU 4 includes a plurality of rollers and selectively executes the following two operations. In the first operation, the print paper that passes the fixing unit 3 is supplied to the paper discharge tray 5 as is. The first operation is executed after completion of one-sided printing or double-side printing. In the second operation, the print paper that passes the fixing unit 3 is temporarily conveyed to the paper discharge tray 5 side, is switched back, and is supplied to the print engine 2. The second operation is executed after completion of image formation on only one side during double-sided printing. The paper discharge tray 5 receives the discharged print paper on which the image is formed.

Figure 2:
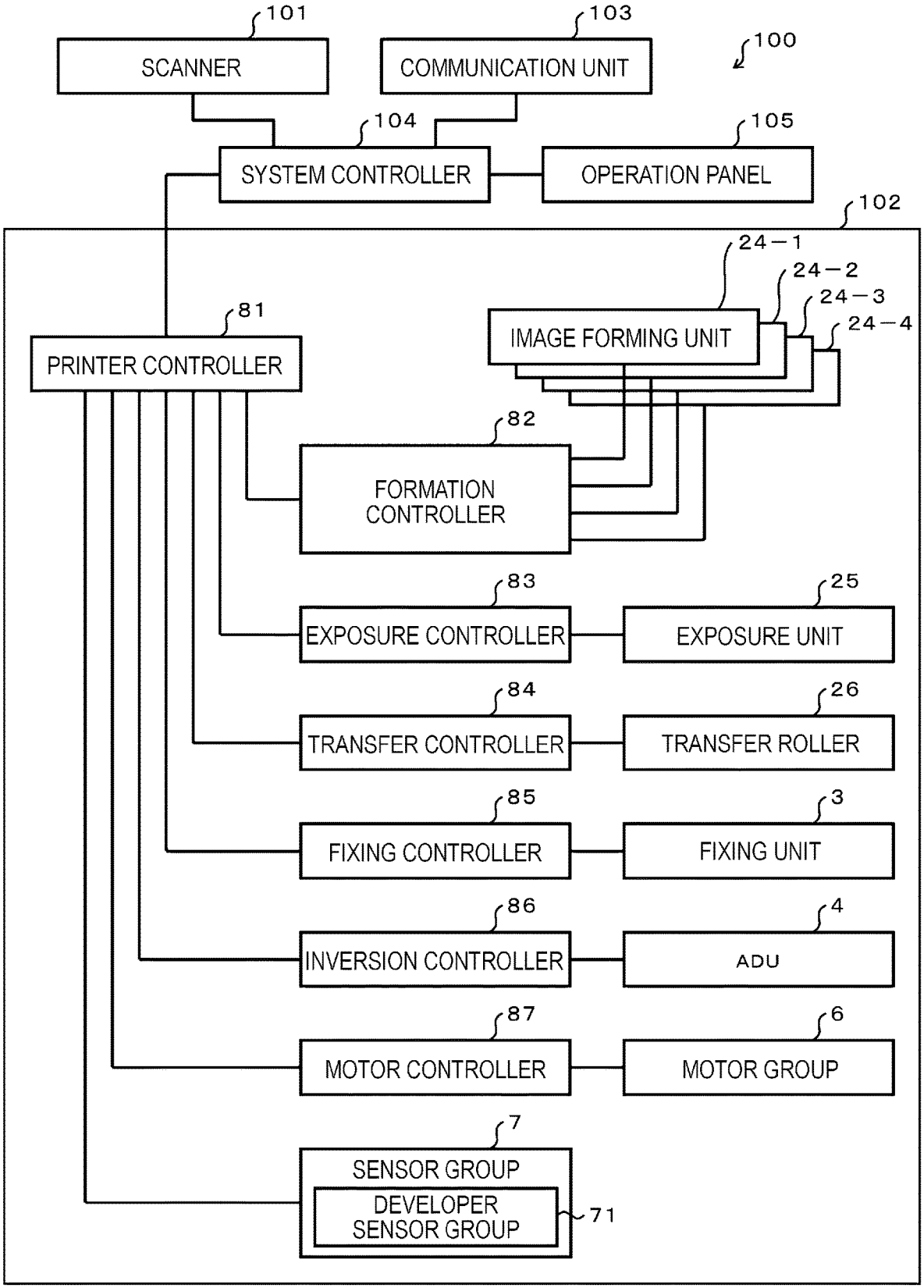
FIG. 2 is a block diagram schematically illustrating a configuration relating to a control of the MFP illustrated in FIG. 1, according to an example embodiment.

FIG. 2 is a block diagram schematically illustrating a configuration relating to a control of the MFP 100. In FIG. 2, the same components as those of FIG. 1 are represented by the same reference numerals, and the detailed description thereof will not be repeated. In addition to the scanner 101 and the printer 102, the MFP 100 includes a communication unit 103 (e.g., a communicator), a system controller 104, and an operation panel 105.

The communication unit 103 executes a process for communicating with an information terminal such as a computer apparatus and an image terminal such as a facsimile apparatus through a communication network such as a local area network (LAN) or a public communication network.

The system controller 104 integrally controls the respective components configuring the MFP 100 in order to implement a predetermined operation as the MFP 100. The predetermined operation as the MFP 100 is, for example, an operation for implementing various functions that are implemented by an existing MFP.

The operation panel 105 includes an input device and a display device. The operation panel 105 inputs an instruction from an operator through an input device. The operation panel 105 displays various information to notify the operator using the display device. The operation panel 105 may be, for example, a touch panel.

The fixing unit 3, the ADU 4, the image forming units 24-1 to 24-4, the exposure unit 25, and the transfer roller 26 in the printer 102 are elements configured to be controlled. In addition to the components, the printer 102 includes a motor group 6 configured to be controlled. The motor group 6 includes a plurality of motors for rotating the pickup rollers 11-1, 11-2, and 11-3, the conveying rollers 12-1, 12-2, and 12-3, the conveying roller 13, the registration roller 14, the support roller 21, the transfer roller 26, the fixing roller 30, a roller in the ADU 4, etc. The printer 102 further includes a sensor group 7, a printer controller 81, a formation controller 82, an exposure controller 83, a transfer controller 84, a fixing controller 85, an inversion controller 86, and a motor controller 87.

The sensor group 7 includes various sensors for monitoring an operation state of the apparatus. The sensor group 7 includes a developer sensor group 71. As illustrated in FIG. 1, the developer sensor group 71 is arranged to face the image carrying surface of the belt 20 at a position of the belt 20 between the image forming unit 24-1 and the transfer roller 26. The developer sensor group 71 includes a plurality of developer sensors. The developer sensors are arranged in the depth direction in FIG. 1. That is, the developer sensors are aligned in a direction perpendicular to the moving direction of the belt 20. The developer sensor group 71 is an example of the detection unit including the developer sensors as a plurality of detectors.

Figure 3:
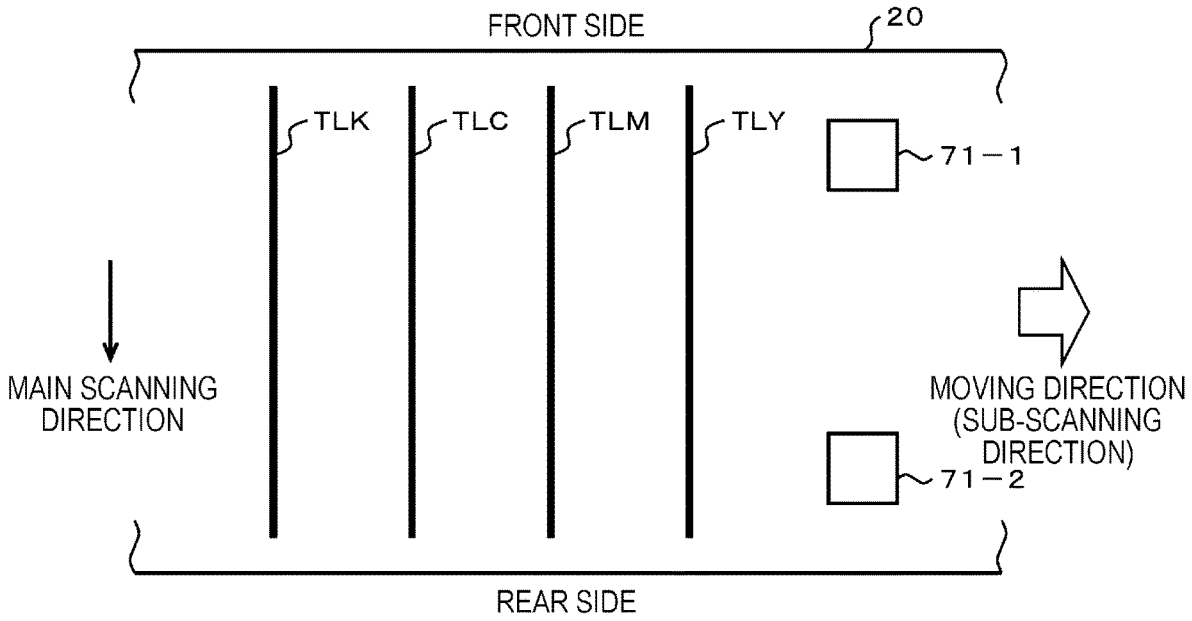
FIG. 3 is a plan view illustrating an arrangement status of developer sensors, according to an example embodiment.

FIG. 3 is a plan view illustrating an arrangement status of the developer sensors. FIG. 3 illustrates an example in which the developer sensor group 71 includes two developer sensors 71-1 and 71-2. The upper side and the lower side of FIG. 3 correspond to the front side and the depth side in the depth direction in FIG. 1, respectively. In the following description, the front side in the depth direction in FIG. 1, that is, the upper side in FIG. 3 will be referred to as "front side". In addition, the depth side in the depth direction in FIG. 1, that is, the lower side in FIG. 3 will be referred to as "rear side".

The developer sensor 71-1 is positioned on the front side. The developer sensor 71-2 is positioned on the rear side. Each of the developer sensors 71-1 and 71-2 detects the developer attached to the image carrying surface of the belt 20. The developer sensors 71-1 and 71-2 may be, for example, a reflective optical sensor. In this case, the developer sensors 71-1 and 71-2 output a voltage value as a digital value corresponding to the amount of reflected light of the light emitted to the image carrying surface of the belt 20. As a result, the developer sensors 71-1 and 71-2 detect the developer attached to the image carrying surface of the belt 20 based on a difference in light reflectivity between the image carrying surface of the belt 20 and the developer.

The printer controller 81 illustrated in FIG. 2 integrally controls the respective components of the printer 102 to implement one or more predetermined operations of the printer 102 under the control of the system controller 104.

The formation controller 82, the exposure controller 83, the transfer controller 84, the fixing controller 85, the inversion controller 86, and the motor controller 87 operate under the control of the printer controller 81 and control operations of the image forming units 24-1 to 24-4, the exposure unit 25, the transfer roller 26, the ADU 4, and the motor group 6, respectively.

Figure 4:
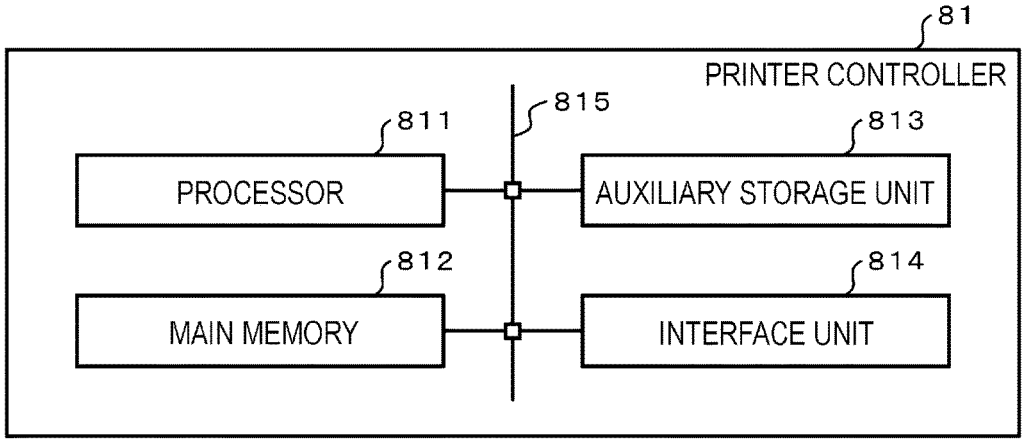
FIG. 4 is a block diagram illustrating a main circuit configuration of a printer controller illustrated in FIG. 2, according to an example embodiment.

FIG. 4 is a block diagram illustrating a main circuit configuration of the printer controller 81. The printer controller 81 includes a processor 811, a main memory 812, an auxiliary storage unit 813 (e.g., an auxiliary memory), an interface unit 814 (e.g., an interface, display), and a transmission line 815.

The processor 811, the main memory 812, and the auxiliary storage unit 813 are connected through the transmission line 815. As such, a computer is configured to execute information processing for the control. The processor 811 corresponds to a central part of the computer. The processor 811 executes information processing described below in accordance with an information processing program such as an operating system, middleware, or an application program.

The main memory 812 corresponds to a main memory part of the computer. The main memory 812 includes a nonvolatile memory area and a volatile memory area. The main memory 812 stores the information processing program in the nonvolatile memory area, and may serve a non-transitory computer readable medium to store instructions, for example. In addition, the main memory 812 may store data required for the processor 811 to execute processing for controlling the respective units (e.g., components of the MPF including an image forming apparatus) in the nonvolatile or volatile memory area. The main memory 812 may use the volatile memory area as a work area where data is appropriately rewritten by the processor 811.

The auxiliary storage unit 813 corresponds to an auxiliary storage part of the above-described computer. The auxiliary storage unit 813 may be, for example, various well-known storage devices such as an electric erasable programmable read-only memory (EEPROM), a hard disk drive (HDD), or a solid state drive (SSD), individually or in combination. The auxiliary storage unit 813 stores data used for the processor 811 to execute various processes and data generated during a process of the processor 811. The auxiliary storage unit 813 stores the information processing program.

The interface unit 814 executes well-known processes for exchanging data between the sensor group 7, the printer controller 81, the formation controller 82, the exposure controller 83, the transfer controller 84, the fixing controller 85, the inversion controller 86, and the motor controller 87. The interface unit 814 may be, for example, well-known interface devices or communication devices used individually or in combination.

The transmission line 815 includes an address bus, a data bus, and a control signal line, and transmits data and a control signal configured to be transmitted between the respective parts connected to each other.

Next, an operation of the MFP 100 configured as described above will be described. Hereinafter, an operation different from that of another existing MFP will be mainly described, and the description of other operations will not be repeated. During a period where it is not necessary to form the image on the print paper, the processor 811 of the printer controller 81 executes an abnormality monitoring process in accordance with the information processing program stored in the main memory 812 or the auxiliary storage unit 813.

Figure 5:
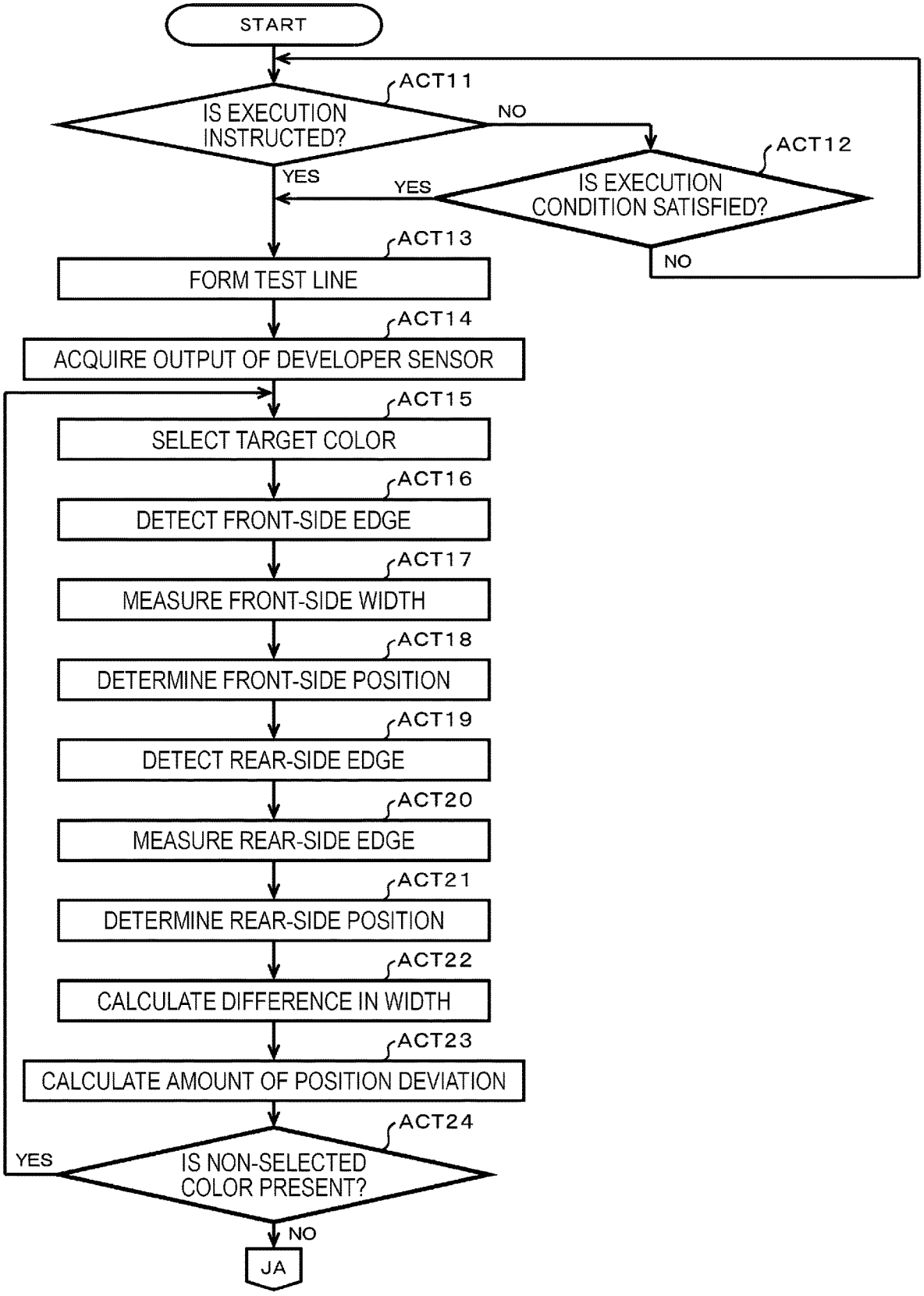
FIG. 5 is a flowchart illustrating an abnormality monitoring process, according to an example embodiment.
Figure 6:
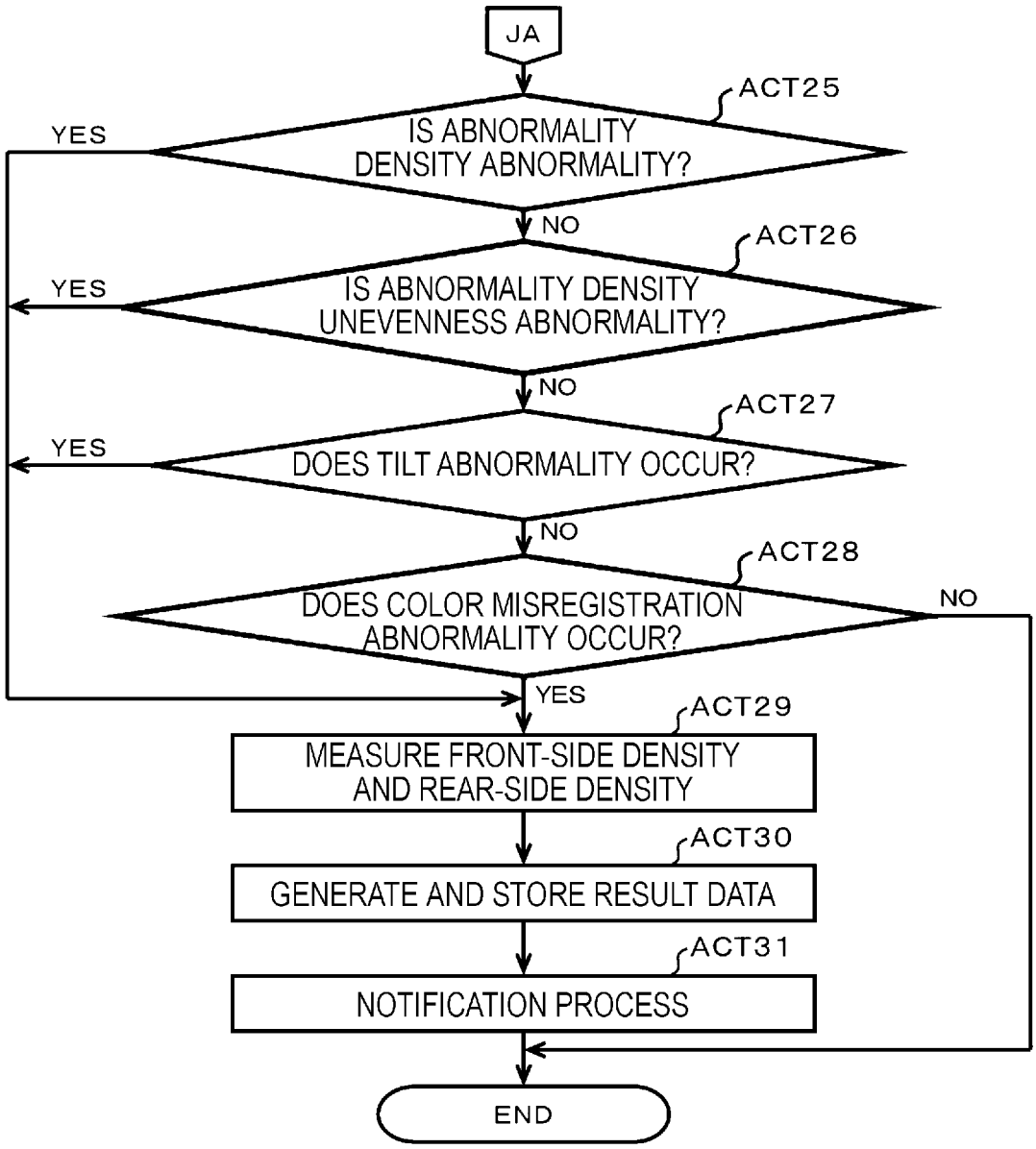
FIG. 6 is a flowchart illustrating the abnormality monitoring process, according to an example embodiment.

FIGS. 5 and 6 are flowcharts illustrating the abnormality monitoring process. In ACT 11, the processor 811 checks whether or not abnormality monitoring execution is instructed. When the instruction cannot be checked, the processor 811 determines NO and proceeds to ACT 12. In ACT 12, the processor 811 checks whether or not an abnormality monitoring execution condition is satisfied. When the processor 811 cannot check that the condition is satisfied, the processor 811 determines NO and returns to ACT 11. Thus, in ACT 11 and ACT 12, the processor 811 waits until the abnormality monitoring execution is instructed or the execution condition is satisfied.

When a manager of the MFP 100 or a person in charge of maintenance thereof wants to check whether or not the MFP 100 is abnormal, the manager or the person accesses the MFP from any information terminal through communication and instructs the abnormality monitoring execution. In this case, the instruction is input to the printer controller 81 through the communication unit 103 and the system controller 104. Alternatively, the manager or the person in charge of maintenance may instruct the abnormality monitoring execution by executing a predetermined operation on the operation panel 105. When the abnormality monitoring execution is instructed, the processor 811 determines YES in ACT 11 and proceeds to ACT 13.

In addition, when a predetermined execution condition for automatically monitoring the abnormality is satisfied, the processor 811 determines YES in ACT 12 and proceeds to ACT 13. The execution condition may be freely determined by a designer of the MFP 100, the manager, or the person in charge of maintenance. Examples of the execution condition that can be assumed include "the duration of a state where image formation is not executed reaches a predetermined period of time", "a humidity measured by a humidity sensor in the sensor group 7 deviates from a predetermined allowable range", "the number of images formed after the previous abnormality monitoring execution exceeds a predetermined number of images", and "a predetermined time is reached".

In ACT 13, the processor 811 forms a test line on the image carrying surface of the belt 20. That is, the processor 811 instructs the formation controller 82 and the exposure controller 83 to operate the image forming units 24-1 to 24-4 and the exposure unit 25 such that the test line is formed on the image carrying surface of the belt 20. At this time, the processor 811 does not operate the transfer roller 26, the fixing unit 3, the ADU 4, and the motor group 6 and does not transfer the test line to the print paper. The test line is an example of the check image. Accordingly, by the processor 811 executing the information processing based on the information processing program, a computer including the processor 811 as a central part functions as the control unit. The computer (e.g., the control unit) is configured to control the image forming units 24-1 to 24-4 as the image forming units such that the check image is formed.

FIG. 3 illustrates a state where test lines TLY, TLM, TLC, and TLK are formed on the image carrying surface of the belt 20. The test line TLY is a yellow line that is formed by the image forming unit 24-4. The test line TLM is a magenta line that is formed by the image forming unit 24-3. The test line TLC is a cyan line that is formed by the image forming unit 24-2. The test line TLK is a black line that is formed by the image forming unit 24-1.

That is, the processor 811 forms the test lines TLY, TLM, TLC, and TLK of the respective colors including yellow, magenta, cyan, and black to be distant from each other. Each of the test lines TLY, TLM, TLC, and TLK is a line that has a predetermined width in the sub-scanning direction and extends in the main scanning direction. The widths of the test lines TLY, TLM, TLC, and TLK are assumed to be, for example, approximately 1 mm. The length of each of the test lines in the main scanning direction and a formation position thereof are set in a state where the test line pass through detection positions of the developer sensors 71-1 and 71-2. It is not necessary to form a portion of each of the test lines that does not pass through the detection positions of the developer sensors 71-1 and 71-2. Here, the processor 811 operates the image forming units 24-1 to 24-4 and the exposure unit 25 under a condition that the test lines TLY, TLM, TLC, and TLK are formed as described above, and the designed formation of the test lines TLY, TLM, TLC, and TLK is not guaranteed. For example, when there is a change in an image formation density or a main scanning direction due to an operation failure of any one of the image forming units 24-1 to 24-4 or a deviation in installation attitude, there is also a change in the test line that is formed by the image forming unit. The test lines TLY, TLM, TLC, and TLK sequentially pass through the detection positions of the developer sensors 71-1 and 71-2. At this time, output voltage values of the developer sensors 71-1 and 71-2 change depending on a change in reflectivity caused by the developers that form the test lines TLY, TLM, TLC, and TLK.

In ACT 14, the processor 811 acquires the output voltage values of the developer sensors 71-1 and 71-2 at regular time intervals in a predetermined acquisition period, correlate the acquired output voltage values with an acquisition time, and stores the output voltage values and the acquisition time in the main memory 812 or the auxiliary storage unit 813. The acquisition period is determined by, for example, the designer of the MFP 100 as a period where the test lines TLY, TLM, TLC, and TLK pass through the detection positions of the developer sensors 71-1 and 71-2. When the acquisition period ends, the processor 811 proceeds to ACT 15. In ACT 15, the processor 811 selects any one of yellow, magenta, cyan, and black as a color to be processed (hereinafter, referred to as a "target color").

In ACT 16, the processor 811 detects two edges on the front side for the test line of the target color, respectively. For example, the processor 811 analyzes a change in the voltage value acquired from the developer sensor 71-1 for the test line of the target color and detects respective positions of a leading edge (hereinafter, referred to as "first edge") and a trailing edge (hereinafter, referred to as "second edge") in the sub-scanning direction.

Figure 7:
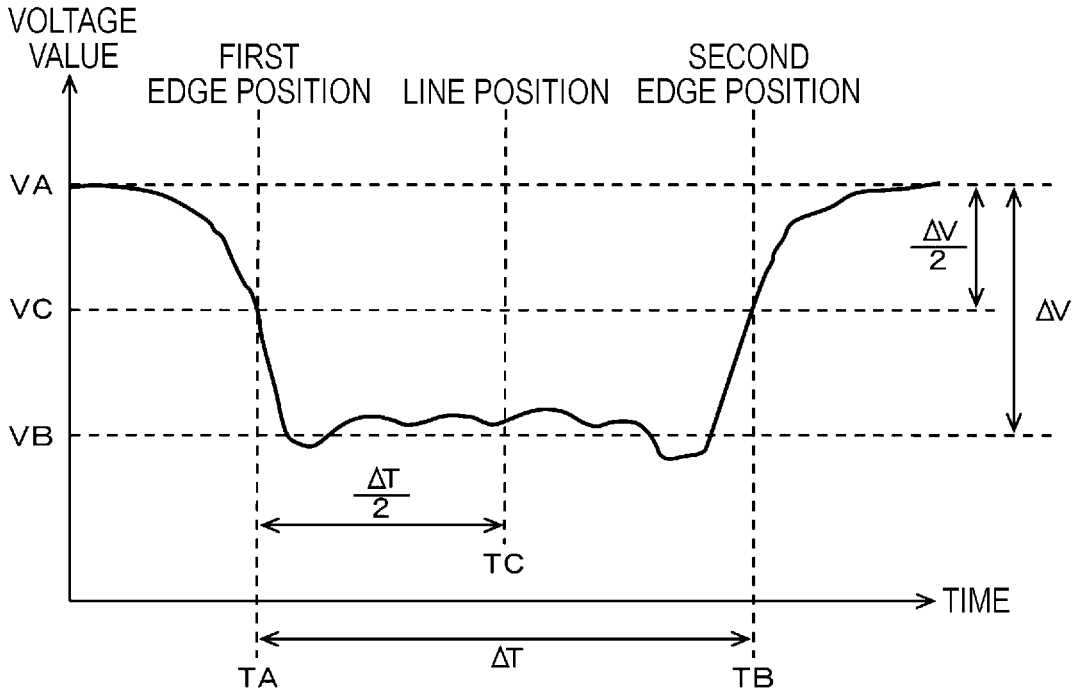
FIG. 7 is a graph illustrating a change in output voltage value of the developer sensor, according to an example embodiment.

FIG. 7 is a graph representing a change in output voltage value of the developer sensor 71-1. FIG. 7 only illustrates a period where one test line passes through the detection position of the developer sensor 71-1. A voltage value VA is a voltage value corresponding to the reflectivity on the image carrying surface of the belt 20. A voltage value VB is an average output voltage value that is decreased by the test line.

When the output voltage value of the developer sensor 71-1 changes as illustrated in FIG. 7, the processor 811 detects the positions of the first edge and the second edge, for example, through the following process. The processor 811 may determine, for example, a peak value of the output voltage value of the developer sensor 71-1 as the voltage value VA, and may determine a predetermined value as the voltage value VA, the predetermined value being a voltage value to be output from the developer sensor 71-1 when a region of the image carrying surface of the belt 20 to which the developer is not attached passes through the detection position of the developer sensor 71-1. The processor 811 calculates an average value of output voltage values in a period where the output voltage value of the developer sensor 71-1 decreases and sets the average value as the voltage value VB. The processor 811 calculates a difference ΔV between the voltage value VA and the voltage value VB. The processor 811 calculates a voltage value VC obtained by subtracting ΔV/2 from the voltage value VA. The processor 811 may calculate the voltage value VC through another equivalent process, for example, a process of adding the voltage value VB to ΔV/2 to calculate the voltage value VC. The processor 811 sets, as the position of the first edge, time TA at which the output voltage value of the developer sensor 71-1 decreases up to the voltage value VC. In addition, the processor 811 sets, as the position of the second edge, time TB at which the output voltage value of the developer sensor 71-1 increases up to the voltage value VC. Thus, by the processor 811 executing the information processing based on the information processing program, a computer including the processor 811 as a central part functions as the edge determination unit configured to determine the position of the edge.

In ACT 17, the processor 811 measures a front-side width of the test line of the target color. For example, the processor 811 calculates the front-side width as the product of a period of time ΔT between time TA and time TB obtained in ACT 16 and a moving speed of the image carrying surface of the belt 20. The processor 811 may use ΔT as a value representing the front-side width as it is. In ACT 18, the processor 811 measures a front-side position of the test line of the target color. For example, the processor 811 sets, as a line position, time TC at which a period of time ΔT/2 is elapsed from time TA. The processor 811 may determine the line position through another equivalent process, for example, a process of acquiring time TC as time at which the period of time ΔT/2 traces back from time TB. That is, the processor 811 determines, as the line position, an intermediate position between the first edge and the second edge.

In ACT 19, the processor 811 detects two edges on the rear side for the test line of the target color, respectively. For example, the processor 811 analyzes a change in voltage value acquired from the developer sensor 71-2 for the test line of the target color, and detects the first and second edges as in ACT 16. In ACT 20, the processor 811 measures a rear-side width of the test line of the target color. For example, the processor 811 measures the rear-side width as in ACT 17 based on the voltage value acquired from the developer sensor 71-2 for the test line of the target color.

In ACT 21, the processor 811 measures a rear-side position of the test line of the target color. For example, the processor 811 measures the rear-side position as in ACT 18 based on the voltage value acquired from the developer sensor 71-2 for the test line of the target color. In ACT 22, the processor 811 calculates a difference between the widths of the front side and the rear side for the test line of the target color. For example, the processor 811 calculates the difference between the widths as an absolute value of a value obtained by subtracting the rear-side width measured in ACT 20 from the front-side width measured in ACT 17. The processor 811 may calculate the difference between the widths through another equivalent process, for example, a process of calculating an absolute value of a value obtained by subtracting the front-side width measured in ACT 17 from the rear-side width measured in ACT 20.

In ACT 23, the processor 811 calculates the amount of position deviation between the front side and the rear side for the test line of the target color. For example, the processor 811 calculates the amount of position deviation as the distance between the front-side position determined in ACT 18 and the rear-side position determined in ACT 21 in the sub-scanning direction. Specifically, the processor 811 acquires, as the amount of position deviation, a period of time obtained by subtracting the time obtained as the rear-side position in ACT 21 from the time obtained as the front-side position in ACT 18. Alternatively, the processor 811 may calculate the amount of position deviation as the product of the calculated period of time and the moving speed of the image carrying surface of the belt 20. The period of time obtained by subtracting the time obtained as the rear-side position from the time obtained as the front-side position may be either a positive value or a negative value. That is, the amount of position deviation may be either a positive value or a negative value.

In ACT 24, the processor 811 checks whether or not a color that is not selected while repeating ACT 15 to ACT 24 is present as described below. When a color that is not selected is present, the processor 811 determines YES and repeats the process after ACT 15 as described above. When ACT 15 is executed again, the processor 811 selects, as the target color, a color that is not selected while repeating ACT 15 to ACT 24. Thus, the processor 811 repeats ACT 15 to ACT 23 while sequentially selecting the respective colors of yellow, magenta, cyan, and black as the target color. After the execution of ACT 15 to ACT 23 for all the colors ends, the processor 811 determines NO in ACT 24 and proceeds to ACT 25 in FIG. 6.

In ACT 25, the processor 811 checks whether or not the density is abnormal. For example, when the actual image formation density in the image forming unit 24-1 decreases to a value lower than a predetermined density, the width of the test line TLK in the sub-scanning direction is less than a predetermined width. Conversely, when the actual image formation density in the image forming unit 24-1 increases to a value higher than a predetermined density, the width of the test line TLK in the sub-scanning direction is more than a predetermined width. For example, the processor 811 determines whether or not each of the front-side width measured in ACT 18 and the rear-side width measured in ACT 20 in FIG. 5 for each of the colors deviate from a predetermined allowable range. The allowable range may be freely determined by the designer of the MFP 100, the manager, or the person in charge of maintenance as a range including the predetermined width for the test line. When any one of the measured front-side width and the measured rear-side width deviates from the allowable range, the processor 811 determines YES and proceeds to ACT 29. However, when all of the measured front-side width and the measured rear-side width are in the allowable range, the processor 811 determines NO and proceeds to ACT 26.

In ACT 26, the processor 811 checks whether or not a density unevenness abnormality occurs. For example, when the actual image formation densities of the image forming unit 24-2 on the front side and the rear side are different from each other, the widths of the test line TLC on the front side and the rear side in the sub-scanning direction are different from each other. For example, the processor 811 determines whether or not the calculated difference in ACT 22 in FIG. 5 for each of the colors is higher than or equal to a predetermined first threshold. The first threshold may be freely determined by a designer of the MFP 100, the manager, or the person in charge of maintenance. When any one of the calculated differences is higher than or equal to the first threshold, the processor 811 determines YES and proceeds to ACT 29. However, when all the calculated differences are lower than the first threshold, the processor 811 determines NO and proceeds to ACT 27. The processor 811 may execute another equivalent determination process, for example a process of checking whether or not all the calculated differences are higher than the first threshold.

In ACT 27, the processor 811 determines whether or not a tilt abnormality occurs. For example, when the main scanning direction in the image forming unit 24-3 is tilted with respect to the normal direction, a direction of the test line TLM is tilted with respect to the normal direction. For example, the processor 811 determines whether or not the calculated absolute value of the amount of position deviation in ACT 23 in FIG. 5 for each of the colors is higher than or equal to a predetermined second threshold. The second threshold may be freely determined by the designer of the MFP 100, the manager, or the person in charge of maintenance. When any one of the calculated absolute values of the amounts of position deviation is higher than or equal to the second threshold, the processor 811 determines YES and proceeds to ACT 29. However, when all the calculated absolute values of the amounts of position deviation are lower than the second threshold, the processor 811 determines NO and proceeds to ACT 28. The processor 811 may execute another equivalent determination process, for example a process of checking whether or not any one of absolute values of the amounts of position deviation is higher than the second threshold.

In ACT 28, the processor 811 determines whether or not a color misregistration abnormality occurs. For example, when a deviation between the main scanning direction in the image forming unit 24-3 and the main scanning direction in the image forming unit 24-4 is large, the magenta image and the yellow image overlap each other in a state where the images are tilted from each other, color misregistration occurs in the color image. For example, the processor 811 calculates a difference between two colors for the amount of position deviation calculated in ACT 23 in FIG. 5 for each of the colors, and checks whether or not any one of the differences is higher than or equal to a predetermined third threshold. The third threshold may be freely determined by the designer of the MFP 100, the manager, or the person in charge of maintenance. When the difference in the amount of position deviation between a combination of two colors among the respective colors is higher than or equal to the third threshold, the processor 811 determines YES and proceeds to ACT 29. The processor 811 may execute another equivalent determination process, for example a process of checking whether or not any one of the differences is higher than the third threshold.

Thus, when any one of the density abnormality, the density unevenness abnormality, the tilt abnormality, and the color misregistration abnormality occurs, the processor 811 proceeds to ACT 29. The processor 811 determines that any one of the abnormalities occurs based on the positions of the front-side edge and the rear-side edge detected in ACT 16 and ACT 19 in FIG. 5. That is, by the processor 811 executing the information processing based on the information processing program, a computer including the processor 811 as a central part functions as the determination unit. The computer (e.g., the determination unit) is configured to determine the abnormality based on the position of the edge.

In ACT 29, the processor 811 determines a front-side density and a rear-side density for each of the colors. By referring to a predetermined data table, the processor 811 determines a density corresponding to the front-side width determined in ACT 17 of FIG. 5 for each of the colors, and sets this density as the front-side density for each of the colors. In addition, by referring to the predetermined data table, the processor 811 determines a density corresponding to the rear-side width determined in ACT 20 of FIG. 5 for each of the colors, and sets this density as the rear-side density for each of the colors. Thus, by the processor 811 executing the information processing based on the information processing program, a computer including the processor 811 as a central part functions as the density determination unit.

Figure 8:
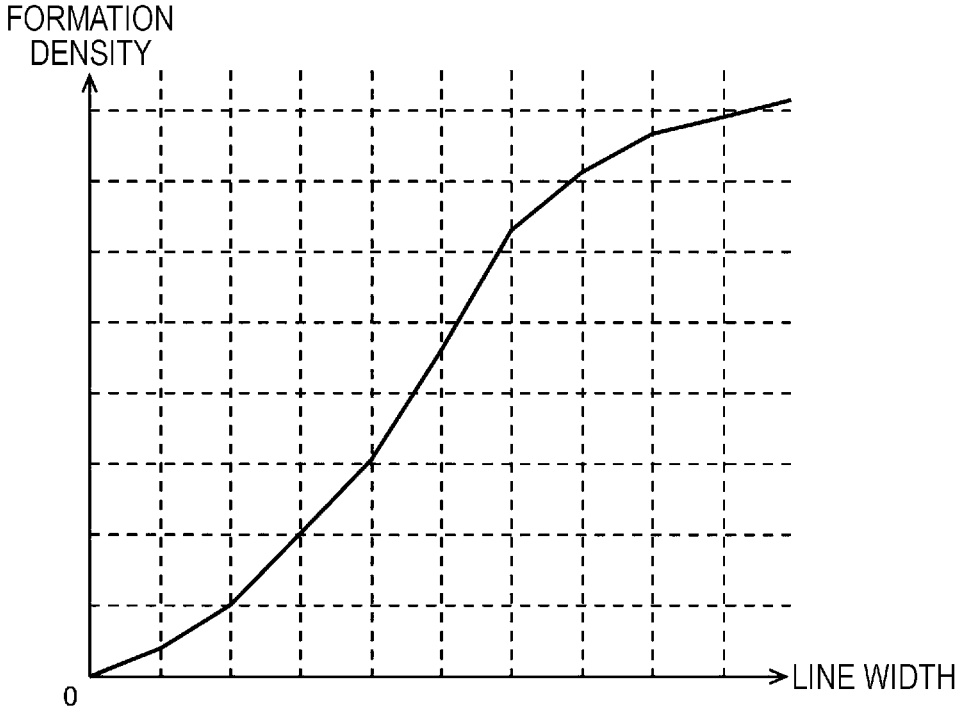
FIG. 8 is a diagram illustrating a relationship between a formation density of an actual image formed by an image forming unit illustrated in FIG. 1 and a width of a test line formed by the image forming unit, according to an example embodiment.

FIG. 8 is a diagram illustrating a relationship between a formation density of an actual image formed by any one of the image forming units 24-1 to 24-4 and a width of a test line formed by the image forming unit. The formation density and the width of the test line correlate to each other as described above and, for example, has a relationship illustrated in FIG. 8. The relationship between the image density and the line width varies depending on the respective colors. Therefore, the data table representing the relationship between the image density and the line width for each of the colors is stored in the main memory 812 or the auxiliary storage unit 813 in advance. The data table may be generated, for example, by the designer of the MFP 100 in consideration of the relationship between the image density and the line width.

In ACT 30, the processor 811 generates result data representing the result of the present abnormality monitoring process, and stores the result data in the main memory 812 or the auxiliary storage unit 813. The result data allows the person in charge of maintenance of the MFP 100 to check the abnormality status. For example, the processor 811 stores, in the result data, the front-side width measured in ACT 17, the rear-side width measured in ACT 20, the difference calculated in ACT 22, and the amount of position deviation calculated in ACT 23 (e.g., see FIG. 5) and the front-side density and the rear-side density determined in ACT 29 (e.g., see FIG. 6). The processor 811 may not store a part of the various values in the result data. Alternatively, the processor 811 may store, in the result data, another value other than the various values such as the front-side position and the rear-side position determined in ACT 18 and ACT 21 (e.g., see FIG. 5). When the processor 811 determines YES in any of ACT 25 to ACT 27, the processor 811 may execute all of ACT 25 to ACT 28 to record the abnormality that occurs. The processor 811 may store, in the result data, data representing the abnormality that occurs.

In ACT 31, the processor 811 executes a notification process for notifying the occurrence of the abnormality. For example, when the processor 811 proceeds from ACT 11 to ACT 13 (e.g., see FIG. 5) in response to the instruction of the abnormality monitoring execution, the processor 811 executes the process for notifying the occurrence of the abnormality to an execution instructor. That is, for example, when the processor 811 is instructed to execute the abnormality monitoring execution through communication from an information terminal, the processor 811 notifies the occurrence of the abnormality to the information terminal through communication. The processor 811 serves as a notifier, by executing, for example, an electronic mail transmission or a push notification. In addition, for example, when the processor 811 is instructed to execute the abnormality monitoring execution through an operation on the operation panel 105, the processor 811 displays a predetermined screen for notification on the operation panel 105. In addition, for example, when the processor 811 proceeds from ACT 12 to ACT 13 in response to the satisfaction of the execution condition, the processor 811 notifies the occurrence of the abnormality to a predetermined information terminal as a notification destination, for example, by an electronic mail transmission or a push notification through communication. Alternatively, for example, the processor 811 displays a predetermined screen for notification on the operation panel 105. Thus, by the processor 811 executing the information processing based on the information processing program, a computer including the processor 811 as a central part functions as the notification unit (e.g., a computer configured to provide a notification).

The processor 811 ends the abnormality monitoring process. When the amount of position deviation is lower than the third threshold for all the combinations of two colors among the respective colors, the processor 811 determines NO in ACT 28, skips ACT 29 to ACT 31, and ends the abnormality monitoring process. At this time, the processor 811 may execute ACT 29 and ACT 30. In this case, the result data may be stored such that a timing at which the abnormality monitoring process is executed can be identified.

When the notification is received by a person other than the person in charge of maintenance, the processor 811 notifies the reception of the notification to the person in charge of maintenance and requests maintenance. When the person in charge of maintenance directly receives the notification from the MFP 100 or receives the request for maintenance as described above, the person in charge of maintenance goes to an installation site of the MFP 100. By checking the result data stored in the main memory 812 or the auxiliary storage unit 813, the person in charge of maintenance checks the abnormality that occurs, and executes required maintenance.

As described above, the MFP 100 determines the status of test line formation on the image carrying surface of the belt 20 depending on the state of the edge of the test line and monitors the abnormality. Accordingly, the abnormality can be monitored through a simplified process as compared to a process of forming a complicated test pattern to accurately measure a required numerical value.

In addition, the MFP 100 determines whether or not the formation density is abnormal based on a gap between two edges of the test line. As a result, the abnormality of the formation density can be monitored through a simplified process.

In addition, the MFP 100 determines the formation density of the test line based on the gap between the two edges of the test line. As a result, information for allowing the person in charge of maintenance to determine a variation in formation density can be provided.

In addition, the MFP 100 monitors the abnormality based on a relationship between positions of the edges of the test line, the edges being respectively detected based on detection statuses of the developer by the two developer sensors 71-1 and 71-2 aligned in a direction intersecting the moving direction of the image carrying surface. As a result, the abnormality of image formation can be monitored through a simplified process.

In addition, the MFP 100 monitors whether or not uniformity of the formation density is abnormal based on the gap between the edges of the test line, the edges being respectively detected based on detection statuses of the developer by the two developer sensors 71-1 and 71-2 aligned in a direction intersecting the moving direction of the image carrying surface. As a result, the abnormality of density unevenness of image formation can be monitored through a simplified process.

In addition, the MFP 100 determines the formation density of the test line for each of the detection positions of the two developer sensors 71-1 and 71-2 based on the gap between the two edges of the test line. As a result, information for allowing the person in charge of maintenance to determine the status of the unevenness of formation density can be provided.

In addition, the MFP 100 monitors whether or not the tilt of the test line is abnormal based on the positions of the edges of the test line, the edges being respectively detected based on detection statuses of the developer by the two developer sensors 71-1 and 71-2 aligned in a direction intersecting the moving direction of the image carrying surface. As a result, the abnormality of tilt of image formation can be monitored through a simplified process.

In addition, when the abnormality occurs, the MFP 100 notifies the occurrence of the abnormality to a predetermined notification destination. As a result, countermeasures against the abnormality can be urged to be taken.

In addition, the MFP 100 monitors the abnormality for each of the image forming units 24-1 to 24-4. As a result, the abnormality of each of the image forming units 24-1 to 24-4 can be monitored.

In addition, the MFP 100 monitors whether or not an abnormality of color misregistration occurs based on a difference between the tilts of test lines formed on the image carrying surface by the image forming units 24-1 to 24-4. As a result, the abnormality of the color misregistration can be monitored through a simple process based on a difference between the tilts of images formed by the image forming units 24-1 to 24-4.

At least one embodiment can be modified as follows in various ways. For example, in at least one embodiment, it may not be necessary to monitor one or more of the density abnormality, the density unevenness abnormality, the tilt abnormality, and the color misregistration abnormality.

ACT 29 in FIG. 6 may be removed. Even in this case, the person in charge of maintenance can learn the formation density based on the front-side width and the rear-side width, for example.

ACT 30 in FIG. 6 may be removed if a countermeasure can be taken in the notification process, for example, an electronic mail message contains the content of the result data or a file representing the result data is attached as an attachment file.

The MFP 100 may further include a developer sensor configured to detect the developer attached to the image carrying surface of the photoreceptor in each of the image forming units 24-1 to 24-4, such that the abnormality is monitored as described above based on the detection result thereof.

At least one embodiment as described above is applicable to various apparatuses other than the MFP, for example, a copying machine, a printer, or a facsimile apparatus as long as an image can be formed using an electrophotographic method in the apparatuses.

The number of image forming units is not limited to four as long as at least one image forming unit is provided. When images formed by a plurality of image forming units do not overlap each other, for example, when one image forming unit is provided, color misregistration abnormality may not be monitored.

Three or more developer sensors may be provided such that the width and the position of the test line are measured and determined based on an output of each of the developer sensors. The various abnormalities can be monitored based on the results of the measurement and the determination.

Only one developer sensor may be provided in at least one embodiment. Further, in at least one embodiment, the density abnormality and the density unevenness abnormality can be compensated for, for example, by adjusting the exposure dose of the exposure unit 25. The position deviation between the front side and the rear side can be compensated for by giving a tilt to image data. For example, a compensation process of adding predetermined reference values to the various values acquired in ACT 16 to ACT 23 may be executed by the processor 811. As a specific process for compensation, for example, a known compensation process can be used.

In at least one embodiment as described above, a part or all of the respective functions that are implemented by the processor 811 through the information processing can also be implemented by hardware that executes information processing not based on a program, for example, a logic circuit. In addition, each of the respective functions can also be implemented by a combination of hardware such as at least one logic circuit and at least one software control.

While certain embodiments have been described, these embodiments have been presented by way of example only, and are not intended to limit the scope of invention. Indeed, the novel apparatus and methods described herein may be embodied in a variety of other forms. Furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus comprising:

an image carrier having an image carrying surface configured to move in a moving direction;

an image forming unit configured to form an image on the image carrying surface with a developer at a formation position;

a transfer unit configured to transfer the image formed on the image carrying surface to a medium at a transfer position;

a detector configured to detect the developer attached to the image carrying surface at a detection position determined between the formation position and the transfer position;

a controller configured to control the image forming unit such that a check image including an edge that extends in a direction intersecting the moving direction is formed in a region of the image carrying surface that passes through the detection position;

perform edge determination to determine a position of the edge based on a detection status of the developer by the detector;

determine whether or not the image forming unit is abnormal based on the position of the edge according to the edge determination;

control the image forming unit such that the check image having a width in the moving direction is formed;

determine positions of two edges aligned along the moving direction of the check image; and determine whether or not a formation density of the image formed by the image forming unit is abnormal based on a gap between the two edges determined by the edge determination.

2. The image forming apparatus of claim 1, wherein the controller is further configured to determine the formation density of the image formed by the image forming unit based on the gap between the two edges determined according to the edge determination.

3. The image forming apparatus of claim 1, wherein the detector includes a plurality of detectors that are configured to detect the developer and are aligned in the direction intersecting the moving direction, and wherein the controller is configured to control the image forming unit such that the check image is formed in each of a plurality of regions that pass through detection positions of the detectors, respectively, and are aligned in the direction intersecting the moving direction, determine the position of the edge based on the detection status of the developer in each of the detectors, and determine whether or not the image former is abnormal based on a relationship between the positions determined by the edge determination.

4. The image forming apparatus of claim 3, wherein the controller is configured to determine whether or not a tilt of the image formed by the image forming unit is abnormal based on a deviation between the positions determined according to the edge determination.

5. The image forming apparatus of claim 1, wherein the controller is further configured to execute a notification process for notifying an abnormality of the image forming unit to a notification destination when the controller determines that the image forming unit is abnormal.

6. The image forming apparatus of claim 1, wherein the image forming unit includes a plurality of forming units configured to form images on the image carrying surface with developers having different colors at different formation positions, the controller controls the image forming unit such that check images are formed by the plurality of forming units and configured to not overlap each other, the controller determines the position of the edge based on the detection status of the developer by the detector for each of the check images formed by the forming units, and the controller determines whether or not the image forming unit is abnormal based on a relationship between the positions of the edges of the images determined according to the edge determination for the images.

7. The image forming apparatus of claim 6, wherein the detector includes a plurality of detectors that is configured to detect the developer and are aligned in the direction intersecting the moving direction, the controller is configured to control the forming units such that the check image is formed in each of a plurality of regions that pass through detection positions of the detectors, respectively, and are aligned in the direction intersecting the moving direction, determine the position of the edge based on the detection status of the developer in each of the detectors, and determine that a tilt of each of the check images formed by the forming units is abnormal based on a deviation between the positions determined according to the edge determination and determine whether or not an abnormality of color misregistration occurs based on the tilts of the images.

8. An image forming apparatus comprising:

an image carrier having an image carrying surface configured to move in a moving direction;

an image forming unit configured to form an image on the image carrying surface with a developer at a formation position;

a transfer unit configured to transfer the image formed on the image carrying surface to a medium at a transfer position;

a detector configured to detect the developer attached to the image carrying surface at a detection position determined between the formation position and the transfer position;

a controller configured to control the image forming unit such that a check image including an edge that extends in a direction intersecting the moving direction is formed in a region of the image carrying surface that passes through the detection position;

perform edge determination to determine a position of the edge based on a detection status of the developer by the detector;

determine whether or not the image forming unit is abnormal based on the position of the edge according to the edge determination, wherein the detector includes a plurality of detectors that are configured to detect the developer and are aligned in the direction intersecting the moving direction, and wherein the controller is configured to control the image forming unit such that the check image is formed in each of a plurality of regions that pass through detection positions of the detectors, respectively, and are aligned in the direction intersecting the moving direction;

determine the position of the edge based on the detection status of the developer in each of the detectors; and determine whether or not the image former is abnormal based on a relationship between the positions determined by the edge determination;

wherein the controller is further configured to control the image forming unit such that check images having the same width in the moving direction are formed, determine the positions of the two edges aligned along the moving direction for each of the check images, and determine whether or not uniformity of a formation density of the image formed by the image forming unit in the direction intersecting the moving direction is abnormal based on a difference in the gap of the two edges between the check images determined according to the edge determination.

9. The image forming apparatus of claim 8, wherein the controller is further configured to determine the formation density of the image formed by the image forming unit based on the gap of the two edges determined according to the edge determination for each of the check images.

10. A method of using an image forming apparatus comprising a carrier, an image forming unit, a transfer unit, a detector, and a controller, the method comprising:

moving the carrier having an image carrying surface in a moving direction;

forming, via the image forming unit, an image on the image carrying surface with a developer at a formation position;

transferring, via the transfer unit, the image formed on the image carrying surface to a medium at a transfer position;

detecting, via the detector, the developer attached to the image carrying surface at a detection position determined between the formation position and the transfer position;

controlling, via the controller, the image former such that a check image including an edge that extends in a direction intersecting the moving direction is formed in a region of the image carrying surface that passes through the detection position;

performing an edge determination to determine a position of the edge based on a detection status of the developer by the detector;

determining whether or not the image forming unit is abnormal based on the position of the edge determined by the edge determination;

determining positions of two edges aligned along the moving direction of the check image; and determining whether or not a formation density of the image formed by the image former is abnormal based on a gap between the two edges determined according to the edge determination.

11. The method of claim 10, further comprising determining the formation density of the image formed by the image former based on the gap between the two edges determined by the edge determination.

12. The method of claim 10, wherein the detector includes a plurality of detectors that are configured to detect the developer and are aligned in the direction intersecting the moving direction, and wherein the method further comprises:

controlling the image forming unit such that the check image is formed in each of a plurality of regions that pass through detection positions of the detectors, respectively, and are aligned in the direction intersecting the moving direction, determining the position of the edge based on the detection status of the developer in each of the detectors, and determining whether or not the image former is abnormal based on a relationship between the positions determined by the edge determination.

13. The method of claim 10, further comprising providing a notification to a notification destination responsive to determining that the image forming unit is abnormal.

* * * * *